US007128808B2

(12) United States Patent
Metsälä et al.

(10) Patent No.: US 7,128,808 B2
(45) Date of Patent: Oct. 31, 2006

(54) METHOD AND APPARATUS FOR IDENTIFYING MAPPING OF PAPER MACHINE ACTUATOR

(75) Inventors: Tapio Metsälä, Tampere (FI); John Shakespeare, Siuro (FI)

(73) Assignee: Metso Automation Oy, Helsinki (FI)

( * ) Notice: Subject to any disclaimer, the term of this patent is extended or adjusted under 35 U.S.C. 154(b) by 498 days.

(21) Appl. No.: 10/154,066

(22) Filed: May 23, 2002

(65) Prior Publication Data

US 2002/0177919 A1 Nov. 28, 2002

Related U.S. Application Data

(63) Continuation of application No. PCT/FI00/01157, filed on Dec. 28, 2000.

(30) Foreign Application Priority Data

Dec. 31, 1999 (FI) ..... 19992849

(51) Int. Cl.
*D21F 13/00* (2006.01)

(52) U.S. Cl. ..... 162/198; 162/263; 162/49; 700/129; 700/128; 700/127; 73/159; 156/64

(58) Field of Classification Search ..... 162/198, 162/263; 700/129, 128, 127
See application file for complete search history.

(56) References Cited

U.S. PATENT DOCUMENTS 5,400,247 A 3/1995 He
5,400,258 A 3/1995 He
5,539,634 A 7/1996 He
5,898,589 A 4/1999 Shakespeare et al.

FOREIGN PATENT DOCUMENTS

| | | |
|---|---|---|
| DE | 4238037 | 4/1993 |
| EP | 0995834 | 4/2000 |
| WO | WO-91/14183 | 9/1991 |
| WO | WO-94/12919 | 6/1994 |
| WO | WO-97/18349 | 5/1997 |
| WO | WO-99/64675 | 12/1999 |

OTHER PUBLICATIONS

Tapio Metsälä and John Shakespeare; *Automatic Identification Of Mapping And Responses For Paper Machine Cross Directional Control*; Control Systems '98; Porvoo, FINLAND.
Seyhan Nuyan, Calvin Fu and Steven Bale; *CD Response Detection For Control*; Proc. TAPPI PCE&I '98; pp. 95-106; Vancouver, CANADA.
D. Gorinevsky, M. Heaven, C. Hagart-Alexander, M. Kean and S. Morgan; *New Algorithms For Intelligent Identification Of Paper Alignment And Nonlinear Shrinkage*; Pulp & Paper 1997; pp. T209-T214; CANADA.
Copy of International Search Report for PCT/FI00/01157, completed Apr. 5, 2001.
Copy of Official Action for Finnish Priority Appl. No. 19992849, dated Oct. 12, 2000.

*Primary Examiner*—Mark Halpern
(74) *Attorney, Agent, or Firm*—Alston & Bird LLP

(57) ABSTRACT

A method and an apparatus for identifying mapping of a paper machine by means of a mapping test. The invention comprises forming a mapping model which takes the linear and non-linear shrinkage of a paper web into account. The mapping test result is analyzed to form a non-linear shrinkage profile and a linear mapping error from it. The linear error and the non-linear shrinkage profile thus obtained are used in the mapping model.

8 Claims, 2 Drawing Sheets

METHOD AND APPARATUS FOR IDENTIFYING MAPPING OF PAPER MACHINE ACTUATOR

CROSS-REFERENCE TO RELATED APPLICATIONS

This application is a continuation of International Application PCT/FI00/01157 filed on Dec. 28, 2000, which designated the U.S. and was published under PCT Article 21 (2) in English, and which is hereby incorporated herein in its entirety by reference.

BACKGROUND OF THE INVENTION

1) Field of the Invention

The invention relates to a method of identifying mapping of a paper machine actuator in a paper making process, the method comprising forming a mapping model which takes linear and non-linear shrinkage of a paper web into account, and performing a mapping test to obtain a mapping test result.

The invention also relates to an apparatus for identifying mapping of a paper machine actuator, the apparatus comprising means for performing a mapping test to obtain a mapping test result, and means for forming a mapping model which takes linear and non-linear shrinkage of a paper web into account.

2) Description of Related Art

In a continuous paper making process, quality parameters measured in the cross direction of a paper web are controlled mainly using actuators arranged in the cross direction with respect to the paper direction. The paper quality parameters are measured with dynamic or static measurement devices, which measure the paper web in the cross direction. The cross-directional measurements are vectors which are called profiles. These profiles are controlled with actuators, which can change the shape of a measured profile. Controlling of the profile requires information on where and how each actuator affects the measured profile. The relation of the cross-directional location of the actuators to the location of the measurement devices is called mapping, and the process or method by which the relation of the cross-directional location of the actuators to the location of the measurement devices is determined is called a mapping test (thus reference herein to "mapping" will be understood to involve a mapping test procedure or method). One example of this is the profile bar in the head box of a paper machine, whose position affects the basis weight of paper. The position of the profile bar is controlled with the measurement information obtained from measurement devices located at the dry end of the paper machine. It is desirable to exert influence on the basis weight cross profile to make it correspond to the shape of the target profile as accurately as possible. The target profile is usually straight, but in some cases it is desirable to increase or reduce the basis weight of the edges of the web to produce paper with as uniform quality as possible. Uniform quality is obtained when the mapping of the measurement of cross-directional control is aligned with the mapping of the actuators.

The further away the actuators and the measurements are from one another in the direction of the paper web, the more difficult it is to align them. The reason for this is that the paper web usually also moves in the cross direction during the paper making process. In addition, the paper shrinks in the cross direction of the paper web. The shrinkage can be divided into linear shrinkage and non-linear shrinkage. A model of mapping consists of a model for cross-directional shift and of a model for shrinkage.

The mapping model may be static or dynamic. In the static case, mapping is modelled using a step response test, and a table showing the correlation between the actuators and the measurements is formed from the test result. This correlation table is used even though the process would change. In the dynamic case, the position of the paper web edges is measured continuously and the model is updated dynamically as the edge information changes. Mapping can also be implemented adaptively, i.e. the mapping model is tuned at the same time as it is used.

The mapping model is usually modelled using a step response test when the control is in the manual mode. In that case the step response test is performed with a few actuators. In the step response test the actuators are moved either manually or automatically from one position to another, which provides a response which is seen in the measurement profile and which indicates the shape and location of the actuator response. The response locations determine mapping of the control, after which the correlation model of mapping is amended to conform to the result provided by the test.

The problem associated with prior art solutions is that the model of mapping has to be corrected manually after an automatic mapping test. The mapping error is obtained from the test results by comparing the result with the current model. If there are errors, as usual, it is difficult to find out which part of the multi-part mapping model contains errors. In that case the mapping model may be corrected with an erroneous parameter, which leads to an unsatisfactory final result. For example, the shape of the non-linear shrinkage profile may change between different lines, and in the case of a new line mapping is no longer in order because the shape differs from that of the shrinkage profile used in the model. Alternatively, the mapping model error can be corrected with linear shrinkage even though the error had been caused by non-linear shrinkage. In that case, the level of cross-directional control decreases as the process changes and it may be necessary to perform the mapping test and correct the error again.

Fu, C. Y., Nuyan, S., Bale, S., *CD Response Detection for Control*, Proc. TAPPI PCE&I '98, Vancouver, Canada, pages 95–106, March discloses how both the movement of actuators and signal processing as well as analysis of the test result can be automated. Metsälä, T., Shakespeare, J., *Automatic Identification of Mapping and Responses for Paper Machine Cross Directional Control*, Control Systems '98, Porvoo, Finland teaches that actuators can also be controlled with inputs instead of state changes. In that case actuators usually need to be controlled so accurately that the control has to be automated and performed by software.

U.S. Pat. No. 5,539,634 discloses a mapping method for reducing the disturbing effect of the state change test signal on the paper to be manufactured by using a pulse sequence as the test signal. The detector uses machine directional noise calculated using profile measurements.

U.S. Pat. No. 5,400,247 discloses a method which comprises determining an actuator resolution decoupling matrix for the controller by first saving the controller's actuator resolution control profile when the process is controlled, and by calculating its effect on the measurement profile with the matrix which does not include decoupling. Approximately at the same time the measured profile change is saved and decoupling is eliminated from it using the decoupling matrix, which is changed as these two signals are minimized. Using recursive identification, the decoupling matrix can be modelled adaptively. The solution relates to identification of decoupling, but does not define mapping of actuators and measurements.

D. Gorinevsky, M. Heaven, C. Hagart-Alexander, M. Kean and S. Morgan, *New algorithms for intelligent identification of paper alignment and nonlinear shrinkage*, Pulp & Paper, Canada, 1997, pages T209–T214 discloses a method for determining mapping and non-linear shrinkage. The solution comprises correlating the predicted change of the actuators with the actual change, and thus test results can also be obtained from the measurement resolution profile. The solution comprises optimising alignment of two parameters of linear mapping by adjusting the predicted change and the actual change to each other as accurately as possible. The solution requires matrixes the size of which may be even 800 * 100, for which reason the method requires a considerable amount of calculation. In addition, the solution comprises generating a shrinkage profile using the inference rules of fuzzy logic.

U.S. Pat. No. 5,400,258 defines a mapping method which comprises filtering the result of the step response test by correlating the vector of the test actuator with the result vector. By using this pattern identification algorithm, noise can be reduced in the test result and mapping points found out. The method employs a measurement profile which comprises as many zones as there are actuators. The resolution of the measurement profile thus corresponds to the actuator resolution. As the result of the mapping test, a shrinkage coefficient profile is calculated, which is used for making the measurement profile to correspond to the actuators by calculating the coefficients of the shrinkage coefficient profile as a relation of the shrinkage of actuator zones to the total shrinkage. Any errors in mapping are corrected by changing the shrinkage coefficient profile. For example, if the error is in linear shrinkage, it is corrected in the shrinkage coefficient profile, which will no longer show the real physical non-linearity of shrinkage. Furthermore, the shrinkage profile is determined only by calculating it from the test results, in which case it is assumed that the result points are completely correct. If the result points have been defined incorrectly, which is rather common in processes in which the actuator responses are rarely identical, the shrinkage coefficient profile will also contain errors, and thus the physical non-linearity of shrinkage may be modelled incorrectly.

An object of the present invention is to provide an improved method and apparatus for identifying mapping between actuators and corresponding measurement points.

BRIEF SUMMARY OF THE INVENTION

The method of the invention is characterized by c) forming a non-linear shrinkage profile of the paper web, b) eliminating the effect of the non-linear shrinkage profile from the mapping test result, d) forming a straight line from the result obtained in step b), d) forming a mapping model which does not include the effect of the non-linear shrinkage profile e) comparing the straight line formed in step c) with the mapping model formed in step d) to produce a first linear mapping error, f) forming a mapping model utilizing the non-linear shrinkage profile, g) comparing the mapping model formed in step f) with the result of the mapping test to produce a second linear mapping error, h) forming the total error of linear errors from the difference between the first linear mapping error and the second linear mapping error, i) determining the magnitude allowed for the total error of linear errors, and j) comparing the magnitude of the total error of linear errors produced with the allowed magnitude of the total error of linear errors, and if the total error of linear errors is sufficiently small, concluding that the linear errors indicate a linear error in the mapping model, and that the currently used non-linear shrinkage profile indicates the non-linear shrinkage profile to be used in the mapping model with sufficient accuracy, in which case the linear error and non-linear shrinkage profile thus determined are used in the mapping model, and if the total error of linear errors is too great, forming a new non-linear shrinkage profile and repeating method steps b) to j).

The apparatus according to the invention is characterized in that the apparatus comprises means for forming a non-linear shrinkage profile of the paper web, means for eliminating the influence of the non-linear shrinkage profile from the mapping test result and means for forming a straight line from the result, means for forming a mapping model without the effect of the non-linear shrinkage profile, means for comparing the straight line formed with the mapping model without the effect of the non-linear shrinkage profile, the means being arranged to produce a first non-linear mapping error, means for forming a mapping model utilizing the non-linear shrinkage profile, means for comparing the mapping model that utilizes the non-linear shrinkage profile with the mapping test result, the means being arranged to produce a second linear mapping error, means for comparing the first linear mapping error with the second linear mapping error to produce the total error of linear errors, means for determining the magnitude allowed for the total error of linear errors, and means for comparing the magnitude of the total error of linear errors with the allowed magnitude, and, if the magnitude is sufficiently small, the linear mapping errors are arranged to form the linear error to be used in the mapping model and the currently used non-linear shrinkage profile is arranged to be used as the non-linear shrinkage profile in the mapping model with sufficient accuracy, and, if the total error of linear errors is too great, the apparatus is arranged to form a new non-linear shrinkage profile of the paper web and to determine a new total error of linear errors.

The invention is based on forming a mapping model which takes linear and non-linear shrinkage of a paper web into account. The invention further comprises analysing a mapping test result and forming a non-linear shrinkage profile N and linear mapping error of the mapping model from the result. To form the non-linear shrinkage profile N and linear mapping error of the mapping model, a non-linear shrinkage profile N is formed and the effect of the non-linear shrinkage profile N formed is eliminated from the mapping test result, after which a straight line is formed from the result. A mapping model is formed by eliminating the effect of the non-linear shrinkage profile N, and the mapping model thus formed is compared with the above-mentioned model is also formed by utilizing the non-linear shrinkage profile N formed, and comparing the mapping model thus formed with the mapping test result to produce a second linear mapping error $E_2$. The second linear mapping error $E_2$ is subtracted from the first linear mapping error $E_1$, and when the difference is close enough to zero, i.e. the linear errors $E_1$ and $E_2$ are substantially equal, the errors indicate that there is a linear error in the mapping model and the currently used non-linear shrinkage profile N indicates the non-linear shrinkage profile N to be used in the mapping model. The total error E of linear errors obtained from the difference between the linear mapping errors forms a penalty function, which is minimized by iterating it by forming a new non-linear shrinkage profile N and by repeating the above-mentioned steps. The idea of a preferred embodiment is that the mapping model is represented as $\underline{Y}=N*R*\underline{X}+S$, where $\underline{X}$ is the actuator location, $\underline{Y}$ is the measurement point corresponding to the actuator, R is the linear total shrinkage of the paper web, N is the non-linear shrinkage profile, and S is the cross-directional shift of the paper web. The idea of a second preferred embodiment is that a trapezoidal graph is formed for the non-linear shrinkage profile N, and the non-linear shrinkage profile N is controlled by adjusting its amplitude and the location of the points of intersection. The idea of a third preferred embodiment is that the width of the paper web is measured with separate measurement devices for the linear total shrinkage of the mapping model.

An advantage of the invention is that mapping can be identified rapidly, accurately and relatively easily. Since the invention also allows identification of the non-linear shrinkage profile and the mapping error of linear shrinkage from the mapping test result, it is quick and simple to correct the mapping error with correct models. Furthermore, the invention provides an automatic calculation routine for updating the mapping model after the mapping test has been performed. The invention allows to separate non-linear shrinkage and the error of linear shrinkage from the result provided by the mapping test so that any errors in the test results of noise-containing and non-ideal responses do not cause an error in the mapping model. If there is an error caused by a poor or a noise-containing test result in some test point, this error cannot substantially be seen in the final result, i.e. the solution according to the invention is rather immune to such errors. Thus an erroneous test result point does not cause e.g. a peak or discontinuity in the shrinkage profile or in the error of linear shrinkage.

In this specification the term 'paper' refers not only to paper but also to paper board and tissue.

BRIEF DESCRIPTION OF THE SEVERAL VIEWS OF THE DRAWINGS

The invention will be described in greater detail in the accompanying drawings, in which FIG. 1 schematically illustrates mapping test results and corresponding errors in a mapping model.

DETAILED DESCRIPTION OF THE INVENTION

Figure 1:
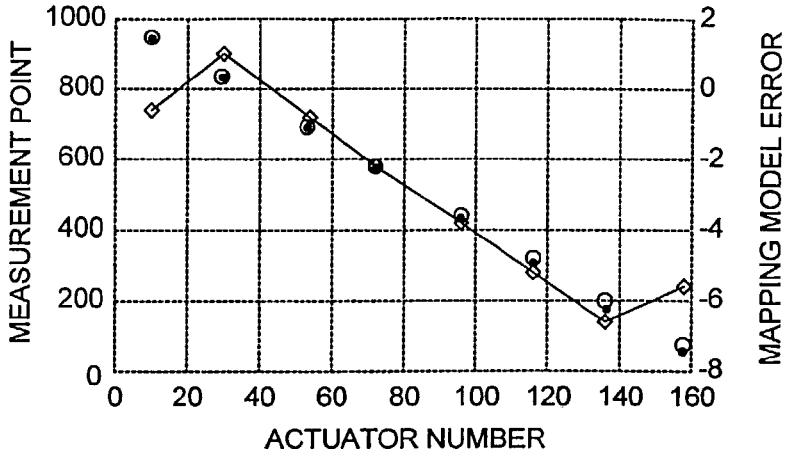

In FIG. 1, the horizontal axis shows the number of the actuator. In the example of FIG. 1 there are 160 adjacent actuators. The left vertical axis shows measurement points. In the case of FIG. 1 there are 1000 measurement points. Measurement points which correspond to certain actuators according to the present mapping model are circled in FIG. 1. For example, approximately the $460^{th}$ measurement point corresponds to the $94^{th}$ actuator. The mapping points provided by the mapping test are marked with dots in FIG. 1. The mapping test can be performed by any method known per se, e.g. by means of the step response test or by using a pulse sequence as the test input or by utilizing a reception method which employs correlated variance as described in Metsälä, T., Shakespeare, J., *Automatic Identification of Mapping and Responses for Paper Machine Cross Directional Control*, Control Systems, '98, Porvoo, Finland. If the mapping model were perfect, all the points would be exactly in the middle of the circle. Since some of the points are not in the middle of the circle, the test actuators include mapping errors, and thus the mapping model has to be corrected to reduce the number of errors or to eliminate them. The mapping model error is shown on the right vertical axis with diamonds connected to one another. In other words, an error profile the absolute value of which should be all the time as close to zero as possible is formed from the mapping model errors. The cause of the mapping model error may be caused by a model error either in linear shrinkage or in non-linear shrinkage. To render the mapping model error as small as possible, non-linear shrinkage and the model error of linear shrinkage are determined from the error profile in the solution according to the invention.

Figure 2:
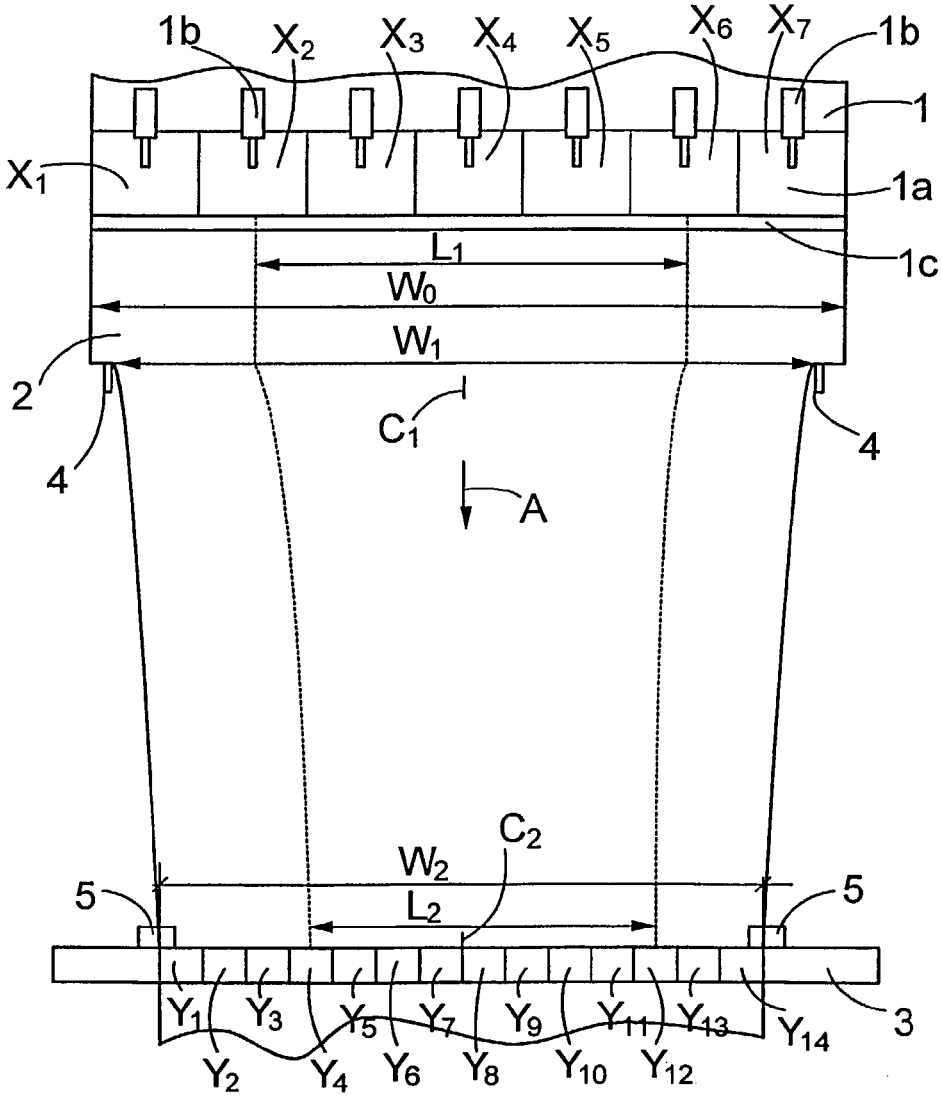
FIG. 2 is a schematic top view of a section of a paper making process.

FIG. 2 is a top view of a section of the paper making process. FIG. 2 shows a head box 1 for feeding pulp to a wire to form a paper web 2. The head box 1 comprises a profile bar 1*a* which is provided with actuators 1*b*. The actuators 1*b* are used for adjusting the position of the profile bar 1*a*, which defines the height of the slice opening 1*c*, which in turn defines the flow speed and thus indirectly the consistence. By adjusting the height of the slice opening 1*c* it is possible to affect the basis weight of the paper to be produced, for example. Each actuator 1*b* acts on a certain part of the profile bar 1*a*, and therefore the profile bar 1*a* is divided into as many zones $X_1$ to $X_7$ as there are actuators 1*b* in FIG. 2. In practice, there is of course more actuators 1*b* in connection with the profile bar 1*a* than is shown in FIG. 2, in which case the profile bar 1*a* is divided into considerably more than seven zones $X_1$ to $X_7$.

FIG. 2 also shows a measuring beam 3, which is provided with a measurement device or devices for measuring properties of the paper web 2, such as basis weight, moisture, roughness or gloss, or another similar property. The measurement points are marked with $Y_1$ to $Y_{14}$. In practice there are naturally considerably more measurement points than is shown in FIG. 2. For the sake of clarity, it can be assumed that two measurement points $Y_1$ to $Y_{14}$ correspond to each zone $X_1$ to $X_7$ in FIG. 2. As regards the process control, it is very important that the exact locations of the paper web 2 points corresponding to the zones $X_1$ to $X_7$ at the measuring beam 3 are known, i.e. mapping of the zones $X_1$ to $X_7$ with respect to the measurement points $Y_1$ to $Y_{14}$.

Mapping also requires information on the width $W_0$ of the paper web 2 immediately after the head box. Part of the paper web edges 2 is typically cut off with trimming cutters 4, i.e. trimmed, and thus it is important to mapping that the paper web 2 width $W_1$ after trimming is known. As the paper web moves forward in the paper machine in the direction shown with arrow A, the paper web dries and at the same time also shrinks, for which reason it is necessary to know the paper web 2 width $W_2$ at the measuring beam 3. The apparatus preferably comprises edge measuring devices 5, by means of which the position of the edges and thus the paper web 2 width $W_2$ at the measuring beam 3 can be defined very accurately. In addition, it is necessary to know the middle point $C_1$ of the paper web 2 after trimming and the middle point $C_2$ of the paper web 2 at the measuring beam 3. The linear total shrinkage R of the paper web is the relation of the paper web 2 width $W_2$ at the measuring beam to the paper web 2 width $W_1$ after trimming, i.e. $R=W_2/W_1$. The cross-directional shift S of the paper web is defined by calculating the difference between the middle point $C_2$ of the paper web 2 at the measuring beam 3 and the middle point $C_1$ of the paper web 2 after trimming, i.e. $S=C_2-C_1$. If, due to the geometry of the measuring devices for example, there is a constant value between the shifts of the above-mentioned middle points, such a value can naturally be taken into account. On the other hand, if the value is constant, it can also be omitted from the equational representation of mapping. By marking the location of actuators with vector $\underline{X}$ and the vector that indicates the corresponding points of the actuators at the measuring beam 3 with $\underline{Y}$, the dynamic mapping model can be represented as $\underline{Y}=R*\underline{X}+S$, assuming that the shrinkage is completely linear. Since the paper web 2 in practice shrinks differently at different points of the web, typically more at the edges of the paper web, it is also necessary to consider non-linear shrinkage compensation in the equation. In that case the shrinkage model can be represented as $\underline{Y}=N*R*\underline{X}+S$, where N is a non-linear shrinkage profile which indicates a normalized shrinkage ratio defined from the middle point of the web to different points in the cross direction. Thus the non-linear shrinkage profile N is a model for the shrinkage where the normalised shrinkage factor is represented as a function of the distance between a location and the web centre.

The mapping model $\underline{Y}=N*R*\underline{X}+S$ represents the point of effect of each actuator in the measurement profile. This is to say that the mapping model is a vector which comprises as many elements as there are actuators. The set of values of the model function is the index number of the measurement zones corresponding to the actuators in the measurement profile, the number of the measurement zones being usually larger than that of the actuators. In that case, the value of actuator profile 150, for example, could be 853.24 according to the model function. In other words, the greatest effect on zone 853.24 of the measurement profile is obtained by moving actuator 150. Processing of the mapping model requires relatively few calculations compared to the processing of a matrix, for example.

The mapping model $\underline{Y}=N*R*\underline{X}+S$ describes physical phenomena of the process, such as shift, linear shrinkage and non-linear shrinkage. In a solution of the invention, the object is to identify these physical phenomena and the variables that describe them as correctly as possible, which provides more information on the state and course of the process. For example, if the non-linear shrinkage profile is identified as asymmetrical, it can be concluded that an area in the dryer section of the paper machine functions better than the rest of the dryer section in the cross direction of the machine.

Figure 3:
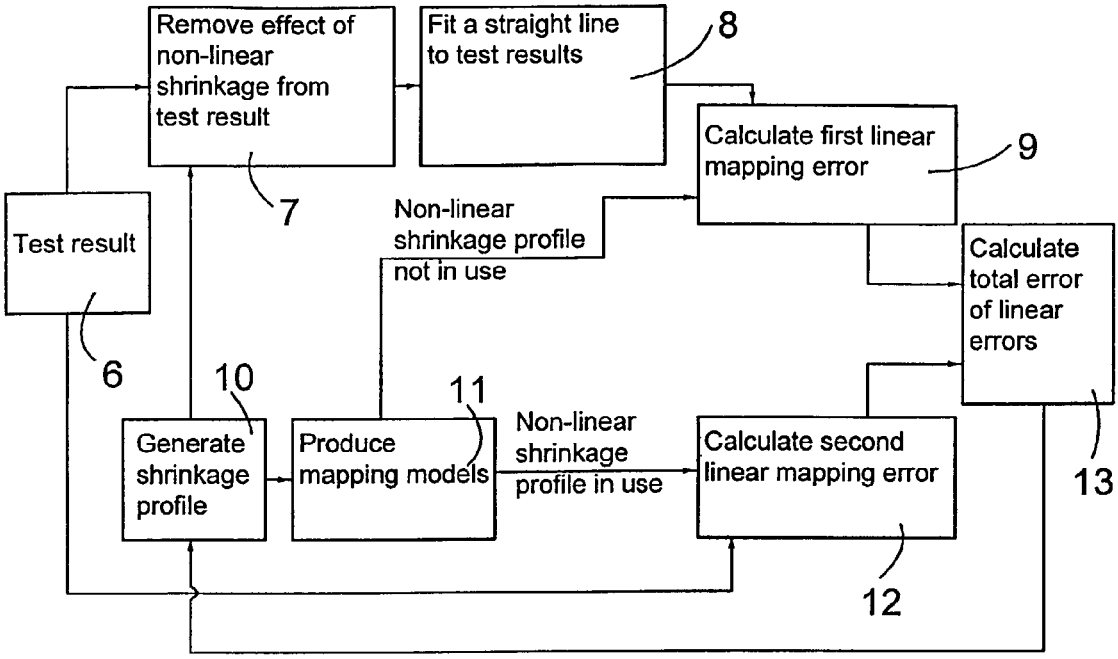
FIG. 3 is a block diagram illustrating a solution of the invention, FIG. 4 schematically illustrates shrinkage profiles.

FIG. 3 is a block diagram illustrating a solution according to the invention. A non-linear shrinkage profile N is produced in block 10 'generate shrinkage profiles'. In the initial situation, a non-linear shrinkage profile N is generated. At its simplest, one is defined as the value of the shrinkage profile, i.e. it is assumed that shrinkage is completely linear. This value can be specified afterwards in the following iteration cycles. According to the experience, it is, however, possible to produce a more accurate non-linear shrinkage profile N. For example, the amplitude used in the-initial situation of the non-linear shrinkage profile N can be found out by means of a mapping test, which will be described in the following with reference to FIG. 2. In the mapping test the paper web 2 is excited with two actuators 1*b*. In the case of FIG. 2, excitation is performed with the actuators 1*b* that correspond to zones $X_2$ and $X_6$. The distance between excitation points is $L_1$. The point at the measuring beam 3 where each actuator responds to the excitation is measured. In the example, response appears in measurement points $Y_4$ and $Y_{12}$. The difference between response points is $L_2$. The linear shrinkage that occurs between the excitation points can be represented as $$R' = \frac{L_2}{L_1}.$$

Since the linear total shrinkage of the paper web is R, the amplitude of the non-linear shrinkage profile N in the initial situation is R'/R.

In block 11 'produce mapping models', two different models for simulated mapping are produced according to equation $\underline{Y}=N*R*\underline{X}+S$. One of the mapping models includes the effect of the shrinkage profile N, whereas the other one lacks this, which means that a mapping model in which the shrinkage is assumed to be linear is used, i.e. the value of the non-linear shrinkage profile N is 1.

Mapping test results, which are illustrated with dots e.g. in FIG. 6, are employed in block 6. In block 7, the effect of the non-linear shrinkage profile N is eliminated from the test result points in calculations using the non-linear shrinkage profile N produced in block 10. After this, a straight line is formed from the test result points e.g. by means of the method of least squares in block 8, in which case the set of test result points is converted into a profile, i.e. a vector is formed therefrom, which includes an equal number of elements and actuators, the elements being adjusted to the set of test results by the above-mentioned method. The straight line concerned is compared to the mapping model produced by block 11, in which it is assumed that the shrinkage profile is one, i.e. to the mapping model in which it is assumed that shrinkage is linear. This is followed by producing a first error $E_1$ of linear mapping in block 9.

The set of test results obtained in block 6, which most probably contains effect of the non-linear shrinkage profile, is supplied to block 12. In block 12, an actuator resolution profile is formed from the set of test results so that the values between the test results are interpolated with linear interpolation. The actuator resolution profile is a vector which contains the same number of elements as is the number of actuators. The profile formed is compared with the mapping model provided by block 11, which includes the non-linear shrinkage profile N. This yields a second linear mapping error $E_2$ in block 12. The total error E of linear errors is formed in block 13 by subtracting the second linear mapping error $E_2$ from the first linear mapping error $E_1$, i.e. $E=E_1-E_2$. The total error E of linear errors is a penalty function, which is to be minimized by the non-linear shrinkage profile to provide a minimized error of the error profiles of linear mapping. A parameter of the error can be calculated from the total error E of linear errors e.g. by the method of least squares. The parameter and the penalty are to be minimized by specifying the non-linear shrinkage profile N in block 10, i.e. by repeating the above-mentioned method steps to render the calculated error parameter sufficiently small. When the remaining linear mapping errors $E_1$ and $E_2$ are nearly equal, they indicate a linear error in the mapping model, and consequently the currently used non-linear shrinkage profile N is sufficiently accurate for use in the mapping model. This means that the non-linear shrinkage profile N and linear model error have been identified on the basis of the mapping test results. If the total error E of linear errors is sufficiently small after the first calculation, iteration cycles are not needed for adjusting the non-linear shrinkage profile N. The point where the difference between the linear mapping errors $E_1$ and $E_2$ is sufficiently small and thus the final result sufficiently accurate can be determined easily by experimenting and/or by utilizing previous experience. Furthermore, the limit values can even be determined on the case-by-case basis. To minimize the penalty, a method other than the least squares method can also be used for calculating the parameter. For example, it is possible to calculate the greatest difference allowed between the linear mapping errors $E_1$ and $E_2$ so that the process can still be controlled reliably. If desired, certain points or sections can be emphasized in the calculations. In addition, it is possible to set certain conditions, e.g. it can be assumed that the shrinkage profile is substantially symmetrical or trapezoidal. Since the test result typically contains errors caused e.g. by measurement noise, this provides the advantage that distortion of the shrinkage profile N caused by erroneous test results can be prevented by allowing only reasonable shapes for the shrinkage profile within certain limits which have been found to be practical.

Figure 4:
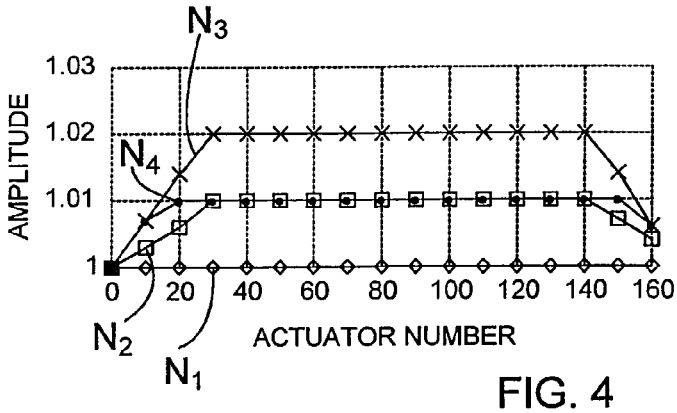
Figure 5:
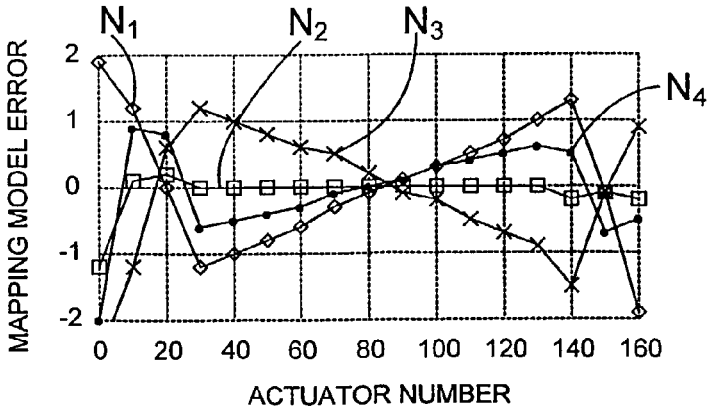
FIG. 5 illustrates error profiles that correspond to the shrinkage profiles of FIG. 4.

FIG. 4 illustrates various non-linear shrinkage profiles N and FIG. 5 shows the corresponding error profiles. The first non-linear shrinkage profile $N_1$ and the corresponding error profile are illustrated with a diamond. The value of the first non-linear shrinkage profile $N_1$ is one, i.e. it is assumed that shrinkage is completely linear. It can be noted that the error profile deviates from zero considerably. Parameter $ISEN_1$, which corresponds to the error profile and has been calculated by the method of least squares, is 217.10, i.e. rather high. The second non-linear shrinkage profile $N_2$ and the corresponding error profile are marked with a square. The graph of the second, third and fourth non-linear shrinkage profiles $N_2$ to $N_4$ is trapezoidal. The amplitude of the second non-linear shrinkage profile $N_2$ is 1.01, and the points of intersection are at actuators 30 and 140. The corresponding error profile is nearly straight and its absolute value is very close to zero. Parameter $ISEN_2$ calculated by the method of least squares is 18.94, i.e. rather small. The points of intersection of the third non-linear shrinkage profile $N_3$ are the same as those of the second shrinkage profile $N_2$, but the amplitude is 1.02. In that case it can be noted that the error profile deviates from zero quite a lot and parameter $ISEN_3$ calculated by the method of least squares is 198.26, i.e. rather high again. The fourth non-linear shrinkage profile $N_4$ and the corresponding error profile are marked with dots. The amplitude of the fourth non-linear shrinkage profile $N_4$ is 1.01, but the points of intersection are at actuators 20 and 150. In that case the error profile also deviates quite a lot from zero and parameter $ISEN_4$ calculated by the method of least squares is 62.20, i.e. considerably higher than that obtained by using the second non-linear shrinkage profile $N_2$ in the mapping model. When the graph of the non-linear shrinkage profile N is trapezoidal and the parameters used are the amplitude and the location of the points of intersection, the correct non-linear shrinkage profile N can be determined easily by means of the solution of the invention. It is advantageous to perform the mapping tests at locations where the mapping error is the greatest according to the experience. Furthermore, when only a linear model is used, it is, according to the experience, advantageous to place the points of intersection in the trapezoidal graph at locations in which the shrinkage error is assumed to be the greatest.

The drawings and the description are only intended to illustrate the inventive concept. The details of the invention may vary within the scope of the claims. Thus the actuator whose mapping is identified may be any actuator of the paper machine, such as the steam box and/or the slice bar of the head box. Furthermore, the blocks of the block diagram shown in FIG. 3 also illustrate means that implement the corresponding function, e.g. computers, microprocessors, calculation units or components of them.

The invention claimed is:

1. A method of identifying a mapping of a paper machine actuator in a paper making process, the method comprising:

a) performing a mapping test to obtain a mapping test result;

b) forming a first non-linear shrinkage profile of the paper web, the non-linear shrinkage profile having an effect associated therewith;

c) linearizing the mapping test result, the mapping test result having the effect of the first non-linear shrinkage profile eliminated therefrom;

d) forming a first mapping model not including the effect of the non-linear shrinkage profile;

e) comparing the linearized mapping test result with the first mapping model to produce a first linear mapping error;

f) forming a second mapping model including the effect of the non-linear shrinkage profile;

g) comparing the second mapping model with the mapping test result to produce a second linear mapping error;

h) forming an actual total error of linear errors from a difference between the first linear mapping error and the second linear mapping error;

i) determining an allowable total error of linear errors; and j) comparing the actual total error of linear errors with the allowable total error of linear errors, and in the event that a difference therebetween is not greater than a predetermined value, then concluding I) that the non-linear shrinkage profile is acceptable to be used in the second mapping model and II) that the first and second linear mapping errors indicate a linear error in the second mapping model, whereby one of the first and second linear mapping errors is then used to correct the linear error in the second mapping model, and in the event that the difference therebetween is larger than the predetermined value, then forming a second non-linear shrinkage profile and repeating method steps c) to j) for the second non-linear shrinkage profile in place of the first non-linear shrinkage profile.

2. A method according to claim 1, wherein linearizing the mapping test result further comprises forming a straight line from a plurality of test result points comprising the mapping test result having the effect of the non-linear shrinkage profile eliminated therefrom.

3. A method according to claim 1, further comprising forming an actuator resolution profile from a plurality of test result points comprising the mapping test result by interpolating between the test result points using linear interpolation.

4. A method according to claim 1, further comprising determining an amplitude of one of the first and second the non-linear shrinkage profiles using a shrinkage profile mapping test having a plurality of excitation points, wherein the amplitude is defined as R'/R, where R is a total linear shrinkage of the paper web, and R' is a linear shrinkage between the excitation points of the shrinkage profile mapping test.

5. A method according to claim 1, wherein forming a second mapping model further comprises forming a second mapping model defined by $\underline{Y}=N*R*\underline{X}+S$, where $\underline{X}$ is an actuator location, $\underline{Y}$ is a measurement point corresponding to the actuator location, R is a total linear shrinkage of the paper web, N is the non-linear shrinkage profile, and S is a cross-directional shift of the paper web.

6. A method according to claim 1, further comprising forming a trapezoidal graph of the non-liner shrinkage profile and controlling the non-linear shrinkage profile by adjusting at least one of an amplitude of the trapezoidal graph and a location of a point of intersection of the trapezoidal graph with the amplitude.

7. A method according to claim 1, further comprising measuring a width of the paper web with at least one edge measuring device to determine a linear total shrinkage of the paper web for use in at least one of the first and second mapping models.

8. A method according to claim 1, further comprising forming a parameter indicative on an estimated magnitude of a total error from a least squares analysis of the actual total error of linear errors.

* * * * *